US006404319B1

(12) United States Patent
Iida et al.

(10) Patent No.: US 6,404,319 B1
(45) Date of Patent: Jun. 11, 2002

(54) VARIABLE INDUCTANCE ELEMENT

(75) Inventors: Naoki Iida, Sabae; Masahiko Kawaguchi, Takefu, both of (JP)

(73) Assignee: Murata Manufacturing, Co., Ltd., Kyoto (JP)

( * ) Notice: Subject to any disclaimer, the term of this patent is extended or adjusted under 35 U.S.C. 154(b) by 19 days.

(21) Appl. No.: 09/648,161

(22) Filed: Aug. 25, 2000

(30) Foreign Application Priority Data

Aug. 25, 1999 (JP) ..... 11-238452

(51) Int. Cl.[7] ..... H01F 5/00

(52) U.S. Cl. ..... 336/200; 336/223; 336/232; 29/602.1

(58) Field of Search ..... 336/200, 223, 336/232; 29/602.1, 606

(56) References Cited

U.S. PATENT DOCUMENTS 4,342,011 A * 7/1982 Iwamoto et al. ..... 333/151
5,140,497 A 8/1992 Kato et al.
5,359,315 A * 10/1994 Inoue et al. ..... 336/200
6,194,248 B1 * 2/2001 Amaya et al.
6,329,715 B1 * 12/2001 Hayashi ..... 257/724

FOREIGN PATENT DOCUMENTS

| | | |
|---|---|---|
| JP | 5-267061 | 10/1993 |
| JP | 6-81124 | 11/1994 |
| JP | 07022819 | 1/1995 |

* cited by examiner

*Primary Examiner*—Anh Mai
(74) *Attorney, Agent, or Firm*—Keating & Bennett, LLP

(57) ABSTRACT

A variable inductance element includes an inductor pattern provided on the upper surface of an insulating substrate. The inductor pattern is a ladder-shaped electrode including a substantially V-shaped frame portion and a plurality of lateral bars extending across two arms of the substantially V-shaped frame portion to be trimmed for adjustment of the inductance. The plurality of lateral bars are arranged at substantially equal intervals. The two arms of the substantially V-shaped frame portion have an angle of about 45° relative to the lateral bars.

20 Claims, 2 Drawing Sheets

VARIABLE INDUCTANCE ELEMENT

BACKGROUND OF THE INVENTION

1. Field of the Invention

The present invention relates to a variable inductance element, and more particularly, to a variable inductance element for use in a mobile communication device such as a mobile telephone or other suitable mobile communication device.

2. Description of the Related Art

In recent years, the size of mobile communication devices such as portable telephones has been substantially decreased, and demands for reducing the size of electronic components for use in the devices has substantially increased. Further, as higher frequencies are used in mobile communication devices, the circuits of the devices become more complex, and moreover, electronic components to be mounted in the devices must have uniform characteristics and high precision.

However, even where each electronic component included in a circuit has parameters with uniform characteristics and high precision, deviations in the parameters of the respective mounted electronic components have an overall or combined effect, so that in some cases, a desired function can be performed. Hence, some of the parameters of the electronic components included in an electronic circuit are variable, if necessary. By finely adjusting the parameters of some of the electronic components, a desired function of the circuit can be performed.

As a conventional trimming method for electronic components of the type described above, a method of trimming a variable inductance component, for example, as shown in FIG. 4 has been generally known. A variable inductance element 55 includes a trimming area 53 provided on the surface of an insulating substrate 50, connected to external electrodes 51 and 52, which is arranged to function as an inductor. The trimming area 53 is irradiated with a laser beam emitted from a laser trimming machine (not shown) while the beam is linearly moved. The trimming area 53 is partially removed corresponding to the movement track of the laser beam, so that a linear trimming groove 54 is produced. Accordingly, the area of the trimming area 53 is altered such that the inductance of the trimming area 53 is finely adjusted.

In the conventional variable inductance element 55, if the area of the trimming area 53 is relatively small, the variable range of the inductance is decreased, so that the circuit cannot be finely adjusted. Therefore, the trimming area 53 must have a large area. On the other hand, when a high precision laser trimming machine is used, the groove width (trimming width) of the trimming groove 54 produced by trimming once is relatively thin. For this reason, when a wide trimming width is required, irradiation with a laser beam must be repeated while the irradiation position is moved in parallel. Hence, the time required to achieve the fine adjustment is substantially increased.

Accordingly, a variable inductance element 65 is shown in FIG. 5. The variable inductance element 65 includes an inductor pattern 61 provided on the surface of an insulating substrate 50 and connected to external electrodes 51 and 52. The inductor pattern 61 is a ladder-shaped electrode including a U-shaped frame portion 61*a* and a plurality of lateral bars 61*b* arranged to cross two arms of the U-shaped frame portion 61*a* to be trimmed for adjustment of the inductance. The variable inductance element 65 is mounted on a printed circuit board or other suitable substrate, and is irradiated with a laser beam from above the variable inductance element 65, so that a trimming groove 54 is produced in the inductance element 65 and simultaneously cuts the lateral bars 61*b* of the inductor pattern 61 individually and sequentially. Accordingly, the inductance between the external electrodes 51 and 52 can be altered in a stepwise manner.

The inductance element 65 has improved cutting workability, since the lateral bars 61*b* are arranged at relatively wide equal intervals. However, the amount of change of the inductance, caused every time one lateral bar 61*b* is cut, is relatively large, since all of the lateral bars 61*b* have an equal length. For this reason, in the inductance element 65, the inductance cannot be altered equally in a stepwise manner. That is, fine adjustment of the inductance is difficult.

To solve this problem, a variable inductance element 75 is shown in FIG. 6. The variable inductance element 75 has an inductor pattern 71 including a U-shaped frame portion 71*a* and a plurality of lateral bars 71*b* extending across two arms of the U-shaped frame portion 71*a*. The lateral bars 71*b* are arranged at intervals that become narrower in a stepwise manner. Hence, the amount of change of the inductance, caused every time one lateral bar 71*b* is cut, remains substantially constant. However, in the inductance element 75, the intervals of the lateral bars 71*b* become narrower as the number of cut lateral bars 71*b* is increased. This increases the possibility that the lateral bars 71*b* may be erroneously cut, thus the adjustment of the inductance is difficult.

SUMMARY OF THE INVENTION

To overcome the above-described problems, preferred embodiments of the present invention provide a variable inductance element having a high Q factor, and in which the inductance is finely adjusted efficiently and accurately.

According to preferred embodiments of the present invention, a variable inductance element is provided including (a) an insulating substrate; and (b) an inductor pattern provided on the surface of the insulating substrate, (c) the inductor pattern being a ladder-shaped electrode having a substantially V-shaped frame portion and a plurality of lateral bars extending across two arms of the substantially V-shaped frame portion and arranged to be trimmed for adjustment of the inductance, the plurality of lateral bars being arranged at substantially equal intervals.

With the above-described configuration, the lengths of the respective lateral bars are sequentially decreased as the distance between the two arms of the substantially V-shaped frame portion is gradually reduced. Accordingly, when the lateral bars are sequentially cut in the order of decreasing length, the inductance of the variable inductance element does not change rapidly.

Preferably, the two arms of the substantially V-shaped frame portion have an angle of approximately 45° relative to the lateral bars. Accordingly, magnetic fields generated in the respective arms are substantially perpendicular to each other, thereby eliminating mutual interference.

Other features, elements, characteristics and advantages of preferred embodiments of the present invention will become apparent from the following detailed description of preferred embodiments thereof with reference to the attached drawings.

DETAILED DESCRIPTION OF PREFERRED EMBODIMENTS

Preferred embodiments of the variable inductance element of the present invention will be described with reference with the accompanying drawings.

Figure 1:
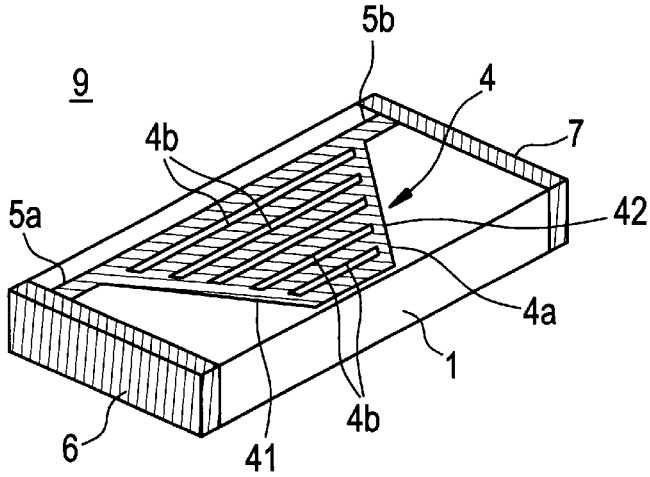
FIG. 1 is a perspective view showing a variable inductance element according to a preferred embodiment of the present invention.

As shown in FIG. 1, after the upper surface of an insulating substrate 1 is polished to have a smooth surface, an inductor pattern 4 is provided on the upper surface of the insulating substrate 1 by a thick-film printing method or a thin-film forming method such as photolithography or other suitable methods. According to the thick-film printing method, a mask having an opening in a desired pattern is placed on the upper surface of the insulating substrate 1, and electrically conductive paste is applied from above the mask, whereby a conductor having a relatively large thickness is formed in the desired pattern (in this embodiment, the inductor pattern 4) on the upper surface of the insulating substrate 1 exposed through the opening of the mask.

An example of photolithography will be described below. A relatively thin conductive film is provided on substantially the entire upper surface of the insulating substrate 1. After this, a resist film (for example, a photosensitive resin or other suitable material) is provided on substantially the entire area of the conductive film by spin coating or printing. Next, a mask film having a desired image pattern is placed on the upper surface of the resist film, and the desired portion of the resist film is hardened by irradiation of UV rays or other suitable process or source. After this, the resist film is peeled off, with the hardened portion thereof remaining, and the exposed portion of the conductive film is removed, whereby a conductor is produced in the desired pattern, and thereafter, the hardened resist film is also removed.

Further, according to another photolithographic method, photosensitive conductive paste is applied on the upper surface of the insulating substrate 1, and a mask film having a predetermined image pattern provided therein covers the photosensitive conductive paste, followed by exposure and development.

The inductor pattern 4 preferably is a ladder-shaped electrode including a substantially V-shaped frame portion 4*a* and a plurality of lateral bars 4*b* extending across two arms 41 and 42 of the substantially V-shaped frame portion 4*a*. The lateral bars 4*b* are arranged at intervals which are relatively wide and are substantially equal to each other, and the lengths of the lateral bars 4*b* become stepwise shorter as the bars 4*b* are positioned nearer to the joining-side of the two arms 41 and 42 of the substantially V-shaped frame portion 4*a*. One end 5*a* of the inductor pattern 4 extends out to the rear portion of the left-side, as viewed in FIGS. 1 and 2, of the insulating substrate 1, while the other end 5*b* extends out to the rear portion of the right-side, as viewed in FIGS. 1 and 2, of the insulating substrate 1. As materials for the insulating substrate 1, glass, glass ceramic, alumina, ferrite, or other suitable materials may be used. As materials for the inductor pattern 4, Ag, Ag—Pd, Cu, Au, Ni, Al, or other suitable materials may be used.

Moreover, a liquid insulating material (polyimide or the like) is coated onto the entire upper surface of the insulating substrate 1 by spin coating, printing or other suitable method, and is dried, whereby an insulating protection film covering the inductor pattern 4 is provided.

Next, external input-output electrodes 6 and 7 are provided on each end portion of the insulating substrate 1 on the right and left hand sides in the longitudinal direction, respectively. The external input-output electrode 6 is electrically connected to the end portion 5*a* of the inductor pattern 4, and the external input-output electrode 7 is electrically connected to the end portion 5*b* of the inductor pattern 4. The external input-output electrodes 6 and 7 are formed by coating and baking conductive paste of Ag, Ag—Pd, Cu, Ni, NiCr, NiCu, or other suitable materials, by dry or wet plating, or by a combination of the coating and the plating, or other suitable methods.

Figure 2:
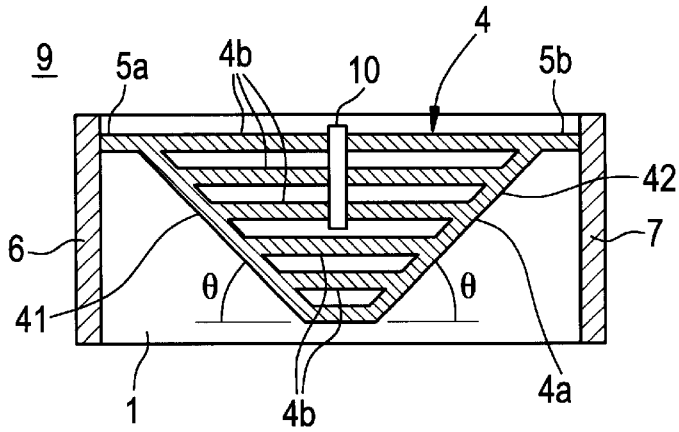
FIG. 2 is a plan view illustrating a method of adjusting the inductance of the variable inductance element of FIG. 1.

After a variable inductance element 9 obtained as described above is mounted onto a printed circuit board or other suitable substrate, the inductor pattern 4 is trimmed. In particular, as shown in FIG. 2, the upper surface of the variable inductance element 9 is irradiated with a laser beam while the beam is moved across the surface of the variable inductance element 9, so that a trimming groove 10 is produced in the variable inductance element 9 and simultaneously cuts the lateral bars 4*b* of the inductor pattern 4 one by one in the order of decreasing length (FIG. 2 shows the state in which three lateral bars 4*b* are cut). In this manner, the inductance between the external electrodes 6 and 7 can be stepwise altered in small amounts. As the number of cut lateral bars 4*b* is increased, the paths of current flowing through the arm 41, the lateral bars 4*b*, and the arm 42 increases. Hence, the inductance between the external electrodes 6 and 7 is increased. In addition, the lengths of the lateral bars 4*b* become gradually shorter as the bars 4*b* are positioned nearer to the joining-side of the arms 41 and 42. Therefore, when the lateral bars 4*b* are sequentially cut with a laser beam for achieving fine adjustment, the inductance of the inductance element 9 is not drastically altered, but rather is altered by a relatively small amount.

Figure 3:
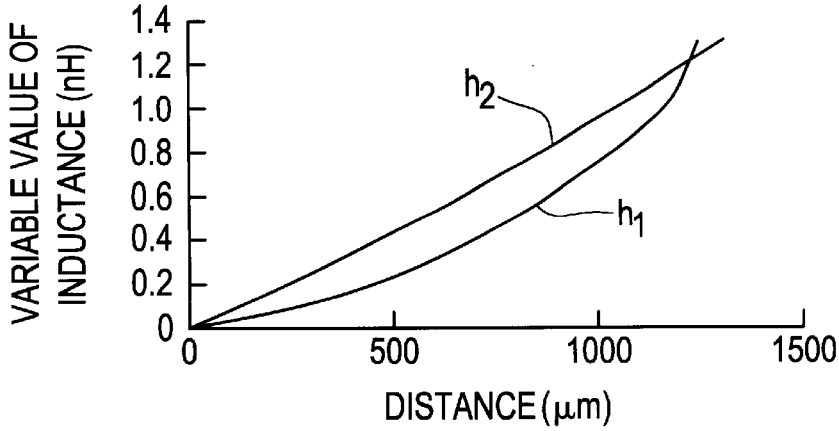
FIG. 3 is a graph showing the change of the inductance with the trimming distance of the variable inductance element of FIG. 1.
Figure 5:
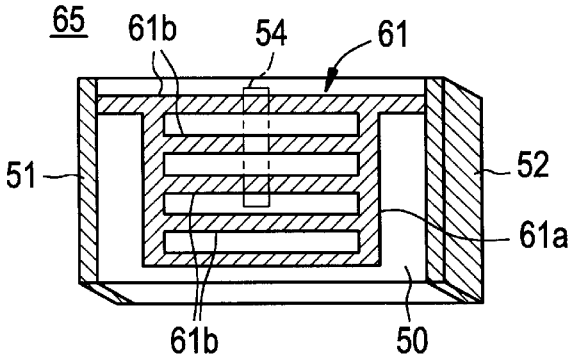
FIG. 5 PRIOR ART
FIG. 5 is a perspective view of a further conventional variable inductance element.
Figure 6:
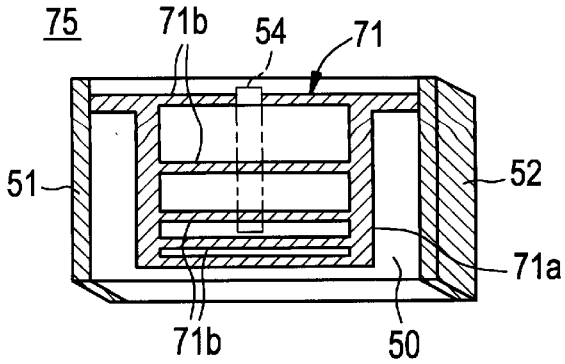
FIG. 6 PRIOR ART
FIG. 6 is a perspective view of still a further conventional variable inductance element.

Regarding the inductance changing from the value at initial trimming with respect to the trimming distance, changes of the inductance of the conventional variable inductance element 65 having a size of approximately 3.2 mm×1.6 mm, shown in FIG. 5 is increased more steeply as the trimming distance is larger, as indicated by solid line h1 in FIG. 3. On the other hand, for the variable inductance element 9 of this preferred embodiment of the present invention having the same size as the above conventional variable inductance element, the inductance changes linearly and constantly as indicated by solid line h2 in FIG. 3. FIG. 3 clearly indicates that the inductance is not drastically altered.

Further, the lateral bars 4*b* are provided at intervals that are relatively wide and are substantially equal to each other. Hence, there is no risk that the lateral bars 4*b* will be erroneously cut when the bars 4*b* are trimmed. Thus, this trimming is easily performed.

Moreover, magnetic fields generated in the two arms 41 and 42 of the substantially V-shaped frame portion 4*a* do not interfere with each other. Thus, the variable inductance element 9 of this preferred embodiment of the present invention produces a high Q factor. In this preferred embodiment, the angle θ between the two arms 41, 42 and the lateral bars 4*b* of the substantially V-shaped frame portion 4*a* is approximately 45°. Accordingly, the two arms 41 and 42 are preferably substantially perpendicular to each other, so that the interference of the magnetic fields generated in the two arms 41 and 42 is minimized and prevented. Thus, a variable inductance element 9 having a further improved Q factor is produced. For example, for the variable inductance element 9 having a size of approximately 3.2 mm×1.6 mm, the Q factor is at least 100.

Figure 4:
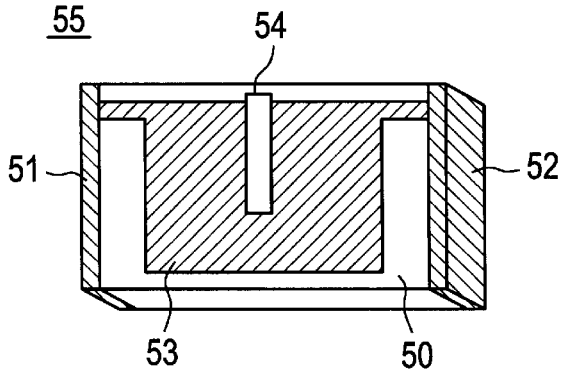
FIG. 4 PRIOR ART
FIG. 4 is a perspective view of a conventional variable inductance element.

By setting the spreading angle between the two arms 41 and 42 of the substantially V-shaped frame portion 4*a* greater, the variable range of the inductance is widened. For example, in the case of a variable inductance element having a size of approximately 3.2 mm×1.6 mm, the adjustment is possible only over a range of about 0.2 nH for the conventional inductance element 55 shown in FIG. 4. On the other hand, for the inductance element 9 shown in FIG. 1, the adjustment range is about 1.5 nH (about 7.5 times greater).

Trimming of the inductor pattern 4 is not restricted to a method using a laser beam, and may be carried out by any method such as sand blasting or any other suitable method. Further, it is not necessary to provide the trimming groove 10. Provided that the inductor pattern 4 is electrically cut, the trimming groove 10 does not have to be formed in a physical sense.

The variable inductance element of preferred embodiments of the present invention is not restricted to the above-described preferred embodiments. Changes and modifications may be made without departing from the spirit and the scope of the present invention. Especially, the above preferred embodiments are described in the production of an individual variable inductance element. To efficiently mass-produce variable inductance elements, a mother substrate (wafer) provided with a plurality of variable inductance elements is produced, and in the final process, the wafer is cut to a product size by a technique such as dicing, scribe-break, laser cutting, or other suitable process.

As seen in the above-description, according to preferred embodiments of the present invention, as the distance between the two arms of the substantially V-shaped frame portion is gradually reduced, the lengths of the respective lateral bars are sequentially decreased, and also, the inductance of the respective lateral bars is sequentially reduced. Accordingly, when the lateral bars are sequentially cut in the order of decreasing length, the inductance of the variable inductance element is not drastically altered. Further, magnetic fields generated in the two arms of the substantially V-shaped frame portion do not readily interfere with each other. Thus, a variable inductance element having a substantially improved Q factor can be provided. Preferably, the two arms of the substantially V-shaped frame portion are set to have an angle of approximately 45° to the lateral bars. Accordingly, the interference of the magnetic fields generated in the respective arms is minimized. A variable inductance element having a further improved Q factor is produced. In addition, the lateral bars are arranged at intervals that are relatively wide and are equal to each other. Accordingly, when the lateral bars are trimmed by a laser trimming machine, adjacent lateral bars are cut accurately and precisely. Trimming work is performed simply and accurately.

It should be understood that the foregoing description is only illustrative of the present invention. Various alternatives and modifications can be devised by those skilled in the art without departing from the invention. Accordingly, the present invention is intended to embrace all such alternatives, modifications and variations that fall within the scope of the appended claims.

What is claimed is:

1. A variable inductance element comprising:

an insulating substrate; and an inductor pattern provided on the surface of said insulating substrate; wherein said inductor pattern is a ladder-shaped electrode including a substantially V-shaped frame portion having two arms, and a plurality of lateral bars extending across said two arms of the substantially V-shaped frame portion and arranged to be trimmed for adjustment of the inductance, said plurality of lateral bars being arranged at substantially equal intervals.

2. A variable inductance element according to claim 1, wherein the two arms of the substantially V-shaped frame portion are arranged at an angle of approximately 45° relative to said lateral bars.

3. A variable inductance element according to claim 1, wherein at least one of said plurality of lateral bars includes end portions which extend to edge portions of said insulating substrate.

4. A variable inductance element according to claim 1, further including external input-output electrodes provided on end portions of said insulating substrate.

5. A variable inductance element according to claim 4, wherein said external input-output electrodes are electrically connected to end portions of said inductor pattern.

6. A variable inductance element according to claim 1, wherein a liquid insulating material is provided on the entire surface of said insulating substrate to define an insulating protection film.

7. A variable inductance element according to claim 1, wherein said insulating substrate includes at least one of the group consisting of glass, glass ceramic, alumina and ferrite.

8. A variable inductance element according to claim 4, wherein said external input-output electrodes includes at least one of the group consisting of Ag, Ag—Pd, Cu, Au, Ni, and Al.

9. A variable inductance element according to claim 6, wherein said liquid insulating material is a polyimide.

10. A method of manufacturing a variable inductance element comprising the steps of:

providing an insulating substrate;

providing a mask having a opening with a desired pattern;

placing the mask over an upper surface of the insulating substrate;

applying an electrically conductive paste on the mask;

removing the mask to produce a conductor having a relatively large thickness in the desired pattern on the upper surface of the insulating substrate exposed through the openings of the mask; wherein the desired pattern is a ladder-shaped electrode including a substantially V-shaped frame portion having two arm, and a plurality of lateral bars extending across said two arms of the substantially V-shaped frame portion and arranged to be trimmed for adjustment of the inductance, said plurality of lateral bars being arranged at substantially equal intervals.

11. A method of manufacturing a variable inductance element according to claim 10, further including the step of trimming a desired number of the plurality of lateral bars to achieve a desired inductance.

12. A method of manufacturing a variable inductance element according to claim 10, wherein the step of trimming is conducted using a laser beam.

13. A method of manufacturing a variable inductance element according to claim 10, further including the steps of applying a liquid insulating material over the entire upper surface of the insulating substrate and drying the liquid insulating material to form an insulating protection film.

14. A method of manufacturing a variable inductance element according to claim 13, wherein said step of applying a liquid insulating material is accomplished by spin coating.

15. A method of manufacturing a variable inductance element according to claim 13, where said step of applying a liquid insulating material is accomplished by printing.

16. A method of manufacturing a variable inductance element according to claim 13, wherein the liquid insulating material is a polyimide.

17. A method of manufacturing a variable inductance element comprising the steps of:

providing an insulating substrate having an upper surface;

applying a conductive film over substantially the entire upper surface;

applying a resist film over substantially all of the conductive film;

placing a make film having a desired image pattern over the resist film;

hardening the desired image pattern of the resist film by irradiation;

peeling the resist film such that the hardened portion remains and the exposed portion of the conductive film is removed; and removing the hardened resist film to produce the desired image pattern; wherein the desired image pattern is a ladder-shaped electrode including a substantially V-shaped frame portion having two arm, and a plurality of lateral bars extending across said two arms of the substantially V-shaped frame portion and arranged to be trimmed for adjustment of the inductance, said plurality of lateral bars being arranged at substantially equal intervals.

18. A method of manufacturing a variable inductance element according to claim 17, wherein the hardening of the resist film is accomplished using UV rays.

19. A method of manufacturing a variable inductance element according to claim 17, wherein the step of trimming is conducted using a laser beam.

20. A method of manufacturing a variable inductance element according to claim 17, further including the steps of applying a liquid insulating material over the entire upper surface of the insulating substrate; and drying the liquid insulating material to produce an insulating protection film.

* * * * *